US007135078B1

(12) United States Patent
Agarwal et al.

(10) Patent No.: US 7,135,078 B1
(45) Date of Patent: Nov. 14, 2006

(54) NICKEL-FREE WHITE GOLD ALLOY COMPOSITIONS WITH REVERSIBLE HARDNESS CHARACTERISTICS

(75) Inventors: Dwarika P. Agarwal, Attleboro, MA (US); Grigory Raykhtsaum, Sharon, MA (US)

(73) Assignee: Leach & Garner Company, North Attleboro, MA (US)

( * ) Notice: Subject to any disclaimer, the term of this patent is extended or adjusted under 35 U.S.C. 154(b) by 0 days.

(21) Appl. No.: 11/294,290

(22) Filed: Dec. 5, 2005

(51) Int. Cl.
*C22C 5/00* (2006.01)
*C22C 5/02* (2006.01)

(52) U.S. Cl. ..... 148/430; 420/508

(58) Field of Classification Search ..... 148/430; 420/508
See application file for complete search history.

(56) References Cited

U.S. PATENT DOCUMENTS 5,919,320 A * 7/1999 Agarwal et al. ..... 148/405

FOREIGN PATENT DOCUMENTS

| | | | |
|---|---|---|---|
| CN | 1584078 | * | 2/2005 |
| DE | 2638837 | * | 3/1978 |
| JP | 11236637 | * | 8/1999 |
| JP | 2005163160 | * | 6/2005 |

* cited by examiner

*Primary Examiner*—Sikyin Ip
(74) *Attorney, Agent, or Firm*—Phillips Lytle LLP

(57) ABSTRACT

A nickel-free white gold alloy composition having selectively reversible hardness characteristics between its annealed- and aged-hardness values, consists essentially of: about 55–60% gold; about 6.0–10.0% palladium; about 5.0–12.0% copper; about 0.1–2.0% zinc; and about 20–30% silver. A 14-karat nickel-free white gold alloy composition, consists essentially of: about 58.5% gold; about 25.0–27.15% silver; about 6.0% palladium; about 5.0–12.0% copper; about 0–2.0% zinc; about 0–0.2% cobalt; about 0–0.005% iridium; and about 0–0.01% lithium.

7 Claims, No Drawings

NICKEL-FREE WHITE GOLD ALLOY COMPOSITIONS WITH REVERSIBLE HARDNESS CHARACTERISTICS

TECHNICAL FIELD

The present invention relates generally to white gold alloy compositions, and, more particularly, to improved nickel-free white gold alloy compositions that preferably have reversible hardness characteristics.

BACKGROUND ART

Gold-based alloys have been used for centuries in the manufacture of jewelry. The most common of these are 14-karat compositions, having a traditional yellow color. However, for certain applications, such as diamond settings, a white gold alloy composition is preferred. Traditionally, white jewelry alloys were platinum-based. However, during World War II, platinum was considered to be a strategic industrial metal, and its usage in jewelry items was therefore limited.

A number of elements have been tried to bleach the color of such gold alloy compositions, but, upon information and belief, only alloys containing palladium and nickel have been practical and successful. The main drawbacks of palladium-containing gold alloys are their high cost and high melting temperature. Additionally, these alloys become very soft when exposed to a soldering operation. Nickel, on the other hand, can produce an allergic reaction. Moreover, nickel-containing alloys appear to be prone to stress-corrosion cracking, which may, for example, lead to a prong failure in a diamond setting.

U.S. Pat. No. 3,981,723 discloses a white gold alloy composition consisting essentially of about 50–54% gold, about 27–21% palladium, about 11–16% silver, about 4.5–8% indium and tin, and about 0.5–2.5% iridium or ruthenium. These alloys are largely intended for use in dental applications, have unsuitably high melting temperatures, are costly, and require excessive amounts of palladium.

U.S. Pat. No. 5,372,779 discloses nickel-free white gold alloy compositions containing about 35–50% gold, about 35–63% silver, about 0.0–7% zinc and/or germanium, and less than about 9% palladium. These alloys are apparently intended for 10-karat gold alloy composition applications, and do not appear to provide reversible hardness characteristics.

U.S. Pat. No. 5,635,131 discloses palladium-containing white gold alloy compositions containing about 58.33% gold, about 29% silver and about 2.67% zinc. These alloys do not appear to have the reversible hardness characteristics of the present invention.

U.S. Pat. No. 5,180,551, which is assigned to the assignee of the present application, discloses a number of yellow gold alloy compositions capable of reversible hardness. These alloys contain not less than about 58.03% gold, not less than about 10% silver, not less than about 2% zinc, not less than about 0.02% cobalt, and copper in a weight percent equal to about 100 less the sum total of the weight percent of the gold, silver, zinc and cobalt. The ratio of the copper amount to the silver amount is between about 2.0 to about 3.8. The ratio of the copper amount to the sum total of the silver amount plus twice the zinc amount is between about 1.3 and about 2.5. These compositions have a desirable gold color having a yellow component in the range of about 17.7 to about 20.5 CIE units, and a red component in the range of about 2.6 to about 4.0 CIE units. These compositions are also capable of being selectively hardened to at least 150% of their annealed-hardness values.

Finally, U.S. Pat. No. 5,919,320, which is also assigned to the assignee of the present application, discloses a plurality of nickel-free white gold alloy compositions having reversible hardness characteristics. These compositions consist essentially of about 55–60% gold, about 12–20% silver, about 8–15% copper, 8–18% palladium, about 0.0–1.0% tin, zinc, iridium, or cobalt and, optionally, about 0.005–0.02% iridium and/or ruthenium. The composition may also have about 0.01–0.03% lithium.

Each of foregoing patents is hereby incorporated by reference.

White gold alloy compositions enjoy a fairly large and stable demand in the jewelry industry as less-expensive alternatives to platinum alloys. The most common and inexpensive whitening element that is used in gold alloy compositions is nickel. In a 14-karat alloy, the amount of nickel may vary up to about 15%. Nickel-containing white gold alloy compositions are susceptible to stress corrosion that often leads to failure of the jewelry article. Nickel is also known to cause an allergic reaction when brought into contact with the skin. That is why "nickel-free" has become a requirement for many white gold alloy compositions that are used to make various jewelry articles. Palladium is the only other practical whitening material that can be used in white gold alloy compositions. The concentration of palladium in commercial 14-karat gold alloy compositions may vary up to about 15%. Palladium-containing white gold alloy compositions are typically more expensive than nickel-containing white gold alloy compositions. More over, the palladium-containing compositions typically have a higher melting temperature and are relatively soft.

Most white gold jewelry is plated with rhodium. When so plated, the requirements for white color become more flexible. The Manufacturing Jewelers and Suppliers of America (MJSA), together with the World Gold Counsel (WGC) have developed and adopted three grades of color for white gold alloy compositions based on the yellowness index ("YI"). These are also governed by ASTM D1925. These three grades are as follows:

| Grade | Color Description | YI |
|---|---|---|
| 1 | Premium | YI < 19.0 |
| 2 | Standard | 19.0 < YI < 24.5 |
| 3 | Off-White | 14.5 < YI < 32.0 |

Alloys having a yellowness index of YI>32.0 are considered to be non-white. Jewelry made with grade one or grade two alloys may be used with or without rhodium plating. However, jewelry made with Grade 3 alloys requires rhodium plating.

Accordingly, it would be generally desirable to provide a series of more economical nickel-free white gold alloy compositions, preferably having reversible hardness characteristics.

DISCLOSURE OF THE INVENTION

The present invention broadly provides improved nickel-free white gold alloy compositions, and, further, to improved 14-karat nickel-free white gold alloy compositions. Preferably, the improved compositions exhibit the desirable property of selectively reversible hardness between their annealed- and age-hardened values.

In one aspect, the invention provides improved nickel-free white gold alloy compositions having selectively reversible hardness characteristics between their annealed- and aged-hardness values, that consist essentially of: about 55–60% gold; about 6.0–10.0% palladium; about 5.0–12.0% copper; about 0.1–2.0% zinc; and about 20–30% silver.

In these compositions, an annealed-hardness value of greater than about 132 VHN is obtained by heating to about 700–800° C. for about 1 hour and quenching in water at room temperature, and an aged-hardness value of greater than about 215 VHN is obtained by heating to a temperature of about 400° C. for about 1–4 hours in a protective atmosphere to prevent oxidation. These compositions have a Grade 3 Off-White color (as defined by the White Gold Task Force, supra) with a yellowness index (YI) of about 31–32. These compositions have a melting point of less than about 1100° C.

In another aspect, the invention provides 14-karat nickel-free white gold alloy compositions, that consist essentially of: about 58.5% gold; about 25.0–27.15% silver; about 6.0% palladium; about 5.0–12.0% copper; about 0–2.0% zinc; about 0–0.2% cobalt; about 0–0.005% iridium; and about 0–0.01% lithium.

These compositions have a Grade 3 Off-White color (as defined by the White Gold Task Force, supra) with a yellowness index (YI) of about 31–32. These compositions are capable of an annealed-hardness value of greater than about 132 VHN by heating to about 700–800° C. for about 1 hour and quenching in water at room temperature, and are capable of an aged-hardness value of greater than about 215 VHN by heating to a temperature of about 400° C. for about 1–4 hours in a protective atmosphere to prevent oxidation. Preferably, the hardness of these compositions is selectively reversible between their annealed- and aged-hardness values. These compositions also have a melting point of less than about 1100° C.

Accordingly, the general object of the invention is to provide improved nickel-free white gold alloy compositions having selectively-reversible hardness characteristics between their annealed- and aged-hardness values.

Another object is to provide improved 14-karat nickel-free white gold alloy compositions. Preferably, these compositions have selectively-reversible hardness characteristics between their annealed- and aged-hardness values.

These and other objects and advantages will become apparent from the foregoing and ongoing written specification, the drawings and the appended claims.

BRIEF DESCRIPTION OF THE DRAWINGS

Table 1 is a table showing the composition, hardness and color of various 14-karat gold alloy compositions.

DESCRIPTION OF THE PREFERRED EMBODIMENTS

With reference to the drawings, Table 1 is a table showing the composition, property and color of fourteen alloys. Hence, the table has various vertical columns. Among these are the alloy number ("Alloy No."); a reference ("Ref."); the specific composition of the alloy, expressed in terms of the weight percent gold ("% Au"), silver ("% Ag"), copper ("% Cu"), iridium ("% Ir"), lithium ("% Li"), nickel ("% Ni"), palladium ("% Pd"), zinc ("% Zn"), and cobalt ("% Co"); hardness, expressed in terms of its Vickers Hardness Number ("VHN") when annealed and when aged, and whether the hardness is reversible between its annealed- and aged-values, and the color expressed in terms of the ASTM yellowness index ("YI") and whiteness grade, as opposed to the White Gold Task Force, lead by the MJSA and the World Gold Counsel. The table has fourteen detailed rows indicating the properties of various alloys.

Thus, Alloy No. 1 was a prior art alloy containing about 58.50% gold, about 29.70% copper, about 6.80% nickel and about 5.00% zinc. This alloy had an annealed hardness of about 145 VHN, and was not reversible. The yellowness index for this alloy was 26.5, and a whiteness grade is characterized as being "Off-White".

Alloy No. 2 was another prior art alloy containing about 58.50% gold, about 22.70% copper, about 10.90% nickel, and about 7.90% zinc. This alloy had an annealed hardness of about 160 VHN, and was not reversible. The alloy had a yellowness index of 18.1, which placed it in the "Premium" whiteness category.

Alloy No. 3 was another prior art alloy having about 58.50% gold, about 19.00% silver, about 10.30% copper, about 12.00% palladium and about 0.20% cobalt. This alloy had annealed- and aged-hardness values of 165 VHN and 250 VHN, respectively. This alloy has reversible hardness, but is expensive because it contains about 12% palladium. This alloy had a yellowness index of 23.0, and a whiteness grade of "Standard".

Alloy No. 4 was another prior art alloy containing of about 58.65% gold, about 30.95% silver, about 9.50% palladium and about 0.90% zinc. This alloy had an annealed-hardness value of about 130. However, its hardness values were not reversible. Its color was found to have a yellowness index of 26.0, and a whiteness grade of "Off-White".

Alloy No. 5 was still another prior art alloy having about 58.50% gold, about 35.50% silver and about 6.00% palladium. This alloy was found to have an annealed-hardness value of about 65 VHN. Its hardness is not reversible. The yellowness index is 30.0, and the whiteness grade is "Off-White".

Alloy No. 6 is a new alloy containing about 58.50% gold, about 29.50% silver, about 10.00% copper, and about 2.00% palladium. This alloy had annealed- and aged-hardness values of about 55 and 100 VHN, respectively. This alloy was not found to be reversible. It also had a yellowness index of about 38.0 and was considered to be "Non-White".

Alloy No. 7 was another alloy containing about 58.50% gold, about 27.50% silver, about 10.00% copper and about 4.00% palladium. This alloy had annealed- and aged-hardness values of 82 and 135, respectively. However, the hardness of this alloy was not selectively reversible. This alloy also had a yellowness index of about 36.0, and was considered to be "Non-White".

Alloy No. 8 is another alloy containing about 58.50% gold, about 25.50% silver, about 10.00% copper and about 6.00% palladium. This alloy had annealed- and aged-hardness values of about 137 and about 215 VHN, respectively. This alloy is selectively reversible between its annealed- and aged-hardness values. The alloy has a yellowness index of about 31.0 and a whiteness grade of "Off-White".

Alloy No. 9 is another alloy containing about 58.50% gold, about 25.00% silver, about 10.00% copper, about 6.00% palladium and about 0.50% zinc. This alloy has annealed- and aged-hardness values of about 145 and about 255 VHN, respectively. The hardness of the alloy is selectively reversible between its aged- and annealed-hardness values. The alloy has a yellowness index of about 32.0, and is considered to have a whiteness grade of "Off-White".

Alloy No. 10 is another alloy containing about 58.50% gold, about 25.50% silver, about 8.00% copper, about 6.00% palladium and about 2.00% zinc. This alloy was found to have annealed- and aged-hardness values of about 172 and about 265, respectively. The hardness of this alloy is reversible between its annealed- and aged-hardness. The alloy has a yellowness index of about 32.0, and is considered to be "Off-White".

Alloy No. 11 is another alloy composition containing about 58.50% gold, about 28.50% silver, about 5.00% copper, about 6.00% palladium and about 2.00% zinc. This alloy has annealed- and aged-hardness values of 132 and 240 VHN, respectively. Its hardness is selectively reversible between its annealed- and aged-hardness values. The alloy has a yellowness index of about 31.0, and is considered to be "Off-White".

Alloy No. 12 is another alloy containing about 58.50% gold, about 23.00% silver, about 12.00% copper, about 6.00% palladium and about 0.50% zinc. This alloy was found to have annealed- and aged-hardness values of about 165 and 275 VHN, respectively. The hardness of this alloy is selectively reversible between each annealed- and aged-hardness values. This alloy has a yellowness index of about 31.0 and is considered to be "Off-White".

Alloy No. 13 is another alloy containing about 58.50% gold, about 27.00% silver, about 8.00% copper, about 6.00% palladium and about 0.50% zinc. This alloy was found to have annealed- and aged-hardness values of about 140 and about 245 VHN, respectively. The hardness of this alloy is selectively reversible between its annealed- and aged hardness values. This alloy has a yellowness index of about 31.0 and was considered to be "Off-White".

Finally, Alloy No. 14 is still another alloy containing about 58.50% gold, about 27.15% silver, about 7.635% copper, about 0.005% iridium, about 0.01% lithium, about 6.00% palladium, about 0.50% zinc and about 0.20% cobalt. This alloy was found to have annealed- and aged-hardness values of about 140 and about 245 VHN, respectively. The hardness of this alloy is reversible between its annealed- and aged-hardness values. This alloy has a yellowness index of about 31.0, and is considered to be "Off-White".

In each of the foregoing tests, the annealed-hardness value was obtained by heating the particular alloy composition to about 700–800° C. for about 1 hour, and then quenching in water at room temperature. The aged-hardness value was obtained by heating the indicated alloy to a temperature of about 400° C. for about 1–4 hours in a protective atmosphere to prevent oxidation.

TABLE 1

| Alloy | | Composition | | | | | | | | | Hardness | | | Color | |
|---|---|---|---|---|---|---|---|---|---|---|---|---|---|---|---|
| | | | | | | | | | | | VHN | VHN | | | |
| No. | Ref. | % Au | % Ag | % Cu | % Ir | % Li | % Ni | % Pd | % Zn | % Co | annealed | aged | Reversible | YI | Grade |
| 1 | prior art | 58.50 | | 29.70 | | | 6.80 | | 5.00 | | 145 | — | No | 26.5 | Off-White |
| 2 | prior art | 58.50 | | 22.70 | | | 10.90 | | 7.90 | | 160 | — | No | 18.1 | Premium |
| 3 | prior art | 58.50 | 19.00 | 10.30 | | | | 12.00 | | 0.20 | 165 | 250 | Yes | 23.0 | Standard |
| 4 | prior art | 58.65 | 30.95 | | | | | 9.50 | 0.90 | | 130 | — | No | 26.0 | Off-White |
| 5 | prior art | 58.50 | 35.50 | | | | | 6.00 | | | 65 | — | No | 30.0 | Off-White |
| 6 | | 58.50 | 29.50 | 10.00 | | | | 2.00 | | | 55 | 100 | No | 38.0 | Non-White |
| 7 | | 58.50 | 27.50 | 10.00 | | | | 4.00 | | | 82 | 135 | No | 36.0 | Non-White |
| 8 | | 58.50 | 25.50 | 10.00 | | | | 6.00 | | | 137 | 215 | Yes | 31.0 | Off-White |
| 9 | | 58.50 | 25.00 | 10.00 | | | | 6.00 | 0.50 | | 145 | 255 | Yes | 32.0 | Off-White |
| 10 | | 58.50 | 25.50 | 8.00 | | | | 6.00 | 2.00 | | 172 | 265 | Yes | 32.0 | Off-White |
| 11 | | 58.50 | 28.50 | 5.00 | | | | 6.00 | 2.00 | | 132 | 240 | Yes | 31.0 | Off-White |
| 12 | | 58.50 | 23.00 | 12.00 | | | | 6.00 | 0.50 | | 165 | 275 | Yes | 31.0 | Off-White |
| 13 | | 58.50 | 27.00 | 8.00 | | | | 6.00 | 0.50 | | 140 | 245 | Yes | 31.0 | Off-White |
| 14 | | 58.50 | 27.15 | 7.635 | 0.005 | 0.01 | | 6.00 | 0.50 | 0.20 | 140 | 245 | Yes | 31.0 | Off-White |

MODIFICATIONS

The present invention expressly contemplates that many changes and modifications may be made within the scope of the appended claims.

Therefore, while several preferred compositions of the improved nickel-free white gold alloy compositions have been shown and described, and several modifications thereof discussed, persons skilled in this art will readily appreciate that various additional changes and modifications may be made without departing from the spirit of the invention, as defined and differentiated by the following claims.

What is claimed is:

1. A 14-karat nickel-free white gold alloy composition, consisting essentially of:

about 58.5% gold;
about 27.15% silver;
about 6.0% palladium;
about 7.635% copper;
about 0.5% zinc;
about 0.2% cobalt;
about 0.005% iridium; and
about 0–0.01% lithium.

2. A 14-karat nickel-free white gold alloy composition as set forth in claim 1 wherein said composition has a Grade 3 Off-White color, as defined by the White Gold Task Force.

3. A 14-karat nickel-free white gold alloy composition as set forth in claim 2 wherein said composition has a yellowness index (YI) of about 31.

4. A 14-karat nickel-free white gold alloy composition as set forth in claim 1 wherein said composition is capable of an annealed-hardness value of about 140 VEN by heating to about 700–800° C. for about 1 hour and quenching in water at room temperature.

5. A 14-karat nickel-free white gold alloy composition as set forth in claim 1 wherein said composition is capable of an aged-hardness value of about 245 VHN by heating to a temperature of about 400° C. for about 1–4 hours in a protective atmosphere to prevent oxidation.

6. A 14-karat nickel-free white gold alloy composition as set forth in claim 1 wherein the ness of said composition isselectively reversible between its annealed- and aged-hardness values.

7. A 14-karat nickel-free white gold alloy composition as set forth in claim 1 wherein said composition has a melting point of less than about 1100° C.

* * * * *